United States Patent [19]

Erdody et al.

[11] 3,974,723

[45] Aug. 17, 1976

[54] APPARATUS FOR CUTTING A WEB OF SHEET MATERIAL

[75] Inventors: Robert G. Erdody, Wilmington, Del.; Paul E. Harmon; Richard S. Tetro, both of Fulton, N.Y.

[73] Assignee: The Black Clawson Company, Middletown, Ohio

[22] Filed: June 20, 1974

[21] Appl. No.: 481,203

[52] U.S. Cl. ..... 83/18; 83/175

[51] Int. Cl.[2] ..... B26D 7/14

[58] Field of Search ..... 83/18, 175

[56] References Cited

UNITED STATES PATENTS

| | | | |
|---|---|---|---|
| 1,453,200 | 4/1923 | Stacho | 83/18 |
| 3,334,532 | 8/1967 | Mylo | 83/18 |
| 3,587,376 | 6/1971 | Hirano | 83/175 X |
| 3,673,905 | 7/1972 | Kono | 83/175 |

*Primary Examiner*—Donald R. Schran

*Attorney, Agent, or Firm*—Biebel, French & Nauman

[57] ABSTRACT

A moving web of material having a high tendency to elongation under stress, such as woven and non-woven plastic fiber or filament webs, is cut by the combined action of a cutting knife which executes its cutting stroke generally in line with and upstream of the web and a grab knife which holds the web at a station spaced closely downstream from the path of the cutting knife and thereby isolates the small length of web between the two knives while the cutting knife completes its stroke.

4 Claims, 12 Drawing Figures

APPARATUS FOR CUTTING A WEB OF SHEET MATERIAL

BACKGROUND OF THE INVENTION

This invention relates to apparatus for cutting a web of sheet material, and particularly a moving web in a processing line which includes a continuous winder.

The invention has special application to installations typified by the continuous winder shown in Harmon et at U.S. Pat. No. 3,794,255 issued Feb. 26, 1974 to the assignee of this application. The knife arrangement shown in that patent has proved to be highly successful in the handling of sheet materials of the types listed therein, namely cardboard, plastics and like materials which are relatively thick or otherwise resistant to conventional cutting knives, but it has not been satisfactory for use with webs of materials which have a high tendency to elongation under stress and/or a low coefficient of friction such for example as woven and non-woven plastic fiber or filament webs.

The problem which arises in the cutting of such webs derives from the basic fact that with any knife which relies for its cutting action on passage through an incompletely supported web, as distinguished from a guillotine type knife which cuts directly against an anvil, the tension in the web is an essential factor in the cutting action. In other words, the tension in that portion of the web which opposes the knife must be adequate to keep the web sufficiently taut for passage of the knife therethrough, rather than merely stretching the web without penetrating it.

This problem is especially acute in connection with webs which have such a high tendency to elongation under stress that they must be handled in a processing line and rewound under very low tension to prevent permanent elongation in the wound roll. A typical example of such a web is a woven plastic of such high tendency to stretching that it should not be handled at tensions exceeding four ounces per linear inch of width, but which cannot be cut successfully across an unsupported run at a tension less than ten pounds, and which may elongate as much as 50% or more in developing ten pounds of tension. If it is attempted to cut such a web with the knife arrangement of U.S. Pat. No. 3,794,255, this required elongation will occur between the knife and the winding roll causing excessive knife travel. In addition, some web materials, depending upon their coefficient of friction, will skid against the driving drum before sufficient tension can be developed to cut the web.

SUMMARY OF THE INVENTION

The invention provides a solution for the problem outlined above in the form of cutting apparatus of novel construction and mode of operation which have the result of effectively isolating a short length of the web in the station where it is to be cut, and applying tension only to that isolated portion, with the aid of a cutting knife, until the tension therein is sufficiently high for the web to be severed by the knife. This isolated section of the web can be as short as one inch or less so that the required elongation to develop the necessary cutting tension is rapidly developed with minimal knife travel.

In a typical application of the invention, the cutting apparatus comprises a pair of knives mounted for movement in opposite directions — a cutting knife which moves upstream of the web during its cutting stroke, and a grab knife which moves downstream of the web in timed relation with the stroke of the cutting knife to seize and hold the web at a location spaced relatively closely downstream from the cutting station of the cutting knife. The two knives thus define the isolated length of web in which the desired cutting tension is developed by relative movement of the knives in opposite directions after they engage the web.

The respective actions of the two knives are aided by providing the grab knife with an edge which has lower ability to cut than the cutting knife; for example, the grab knife may have a serrated edge comprising spaced teeth having gaps therebetween, or if the teeth are regular, they may have a relatively large included angle as compared with the narrow and correspondingly sharper teeth of the cutting knife. The purpose of this arrangement is to assure that the grab knife can penetrate and hold the web without severing while the desired cutting tension is developed therein.

The invention is especially applicable to a continuous winder in a manner similar to that shown in the above U.S. Pat. No. 3,794,255, with either the grab knife or both of the knives being carried by a support mounted to swing about the axis of the driving drum. But the invention is not limited to incorporation in a winder and can be installed at any desired cutting station through which a web to be cut is caused to pass.

DESCRIPTION OF THE PREFERRED EMBODIMENTS

Figure 1:
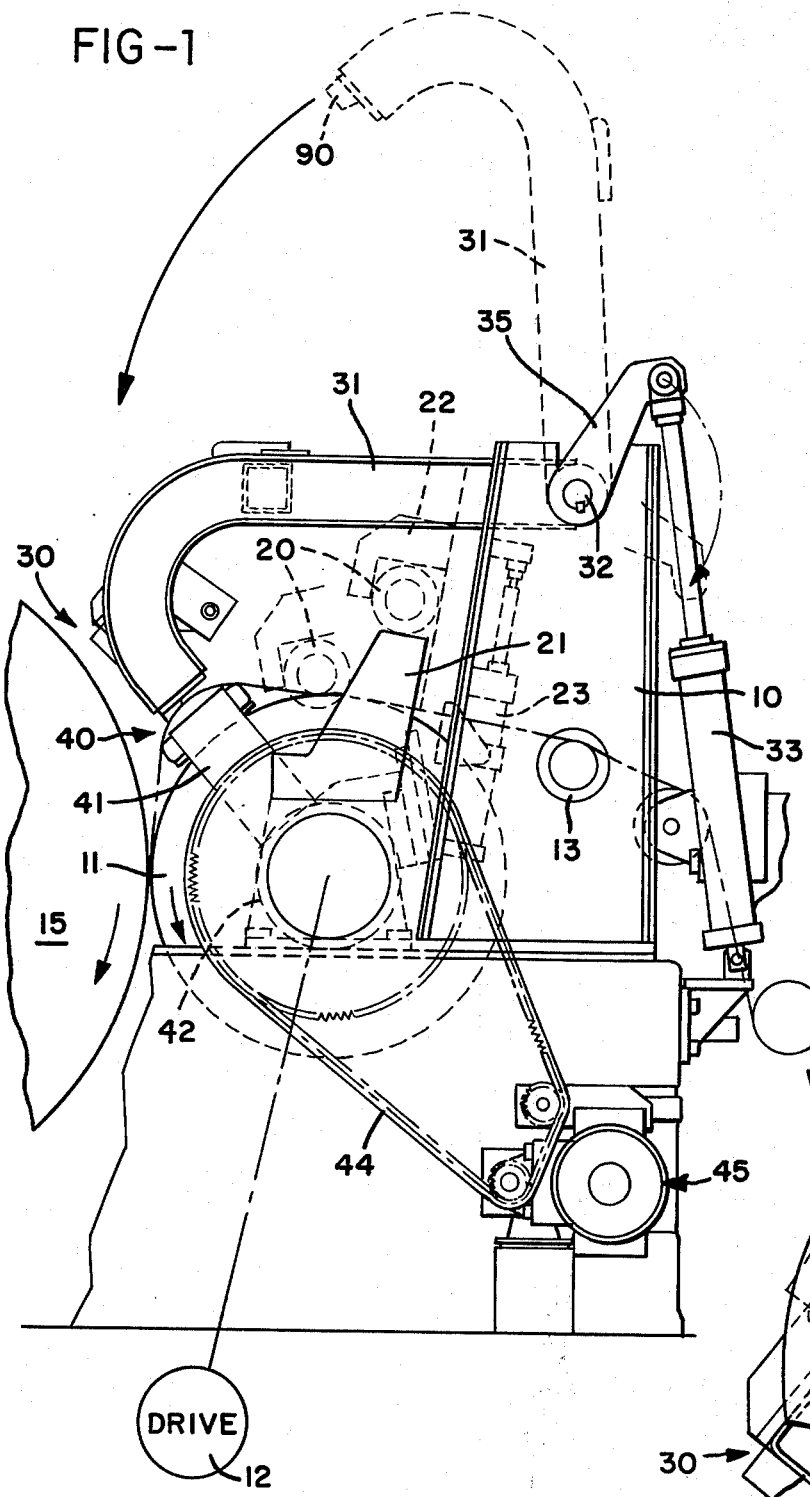
FIG. 1 is a somewhat diagrammatic view in side elevation showing a continuous winder of the single drum type incorporating web cutting apparatus in accordance with the invention.
Figure 2:
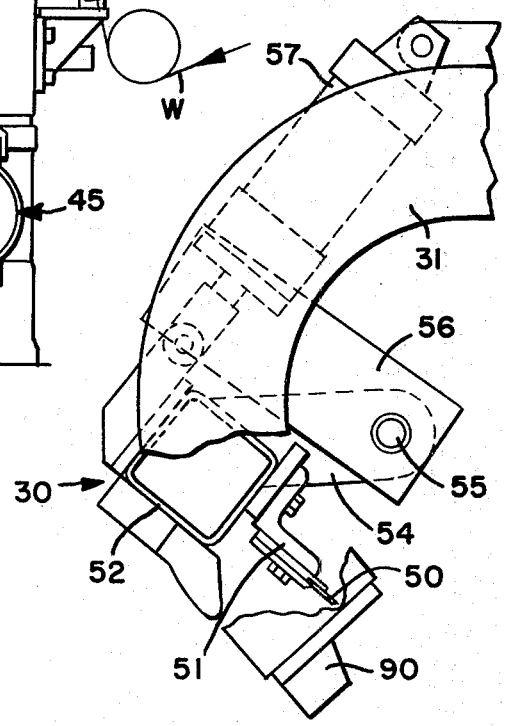
FIG. 2 is a fragmentary view illustrating details of the mounting and operation of the cutting knife in FIG. 1.

FIG. 1 shows a single drum winder constructed generally in accordance with the above U.S. Pat. No. 3,794,255. It includes a pair of opposed end frames 10, only one being shown, which support the driving drum 11 provided with a conventional drive 12 by which it is driven at constant speed. The web W is guided to the drum 11 by a squaring roll 13, and FIG. 1 also shows a substantially fully wound roll 15 in driven contact with drum 11 and supported on secondary ways (not shown)

of any conventional design, for example as shown in Phelps U.S. Pat. No. 2,703,883.

A new core 20 on which the next roll is to be wound is supported on stationary brackets 21 at the ends of drum 11, the core 20 being held by primary arms 22 operated in conventional manner by pressure cylinders 23. The starting position for the new core 20 is shown in dotted lines in FIG. 1, and the new roll is moved therefrom to the secondary ways in conventional manner by primary arms 22 after the full roll 15 has been removed from the winder.

The web cutting apparatus in FIG. 1 comprises two cooperating subassemblies. The cutting knife assembly 30 is supported on the ends of a pair of arms 31 mounted in end frames 10 by pins 32 for pivotal movement between the operating position shown in full lines and their retracted position shown in broken lines, this movement being effected by fluid pressure cylinders 33 through lever arms 35.

The other component of the cutting apparatus is the grab knife assembly 40, which is supported on arms 41 mounted at 42 for rotational movement coaxially with drum 11, the movement of arms 41 being effected and controlled by a chain drive 44 and the motor and transmission indicated generally at 45. The assembly 40 is shown in its operating position in FIG. 1, and it is moved to its rest position, approximately 180° therefrom, during the interval after the full roll 15 has been removed and before the new roll on the core 20 is transferred to the primary arms. This arrangement is basically the same as that of the web support which forms the subject matter of the above U.S. Pat. No. 3,794,255, the movement of the assembly 40 to its operating position being in counterclockwise direction from its rest position and taking place just before cutting and transfer of the web from the full roll 15 to the new core 20.

Figure 4:
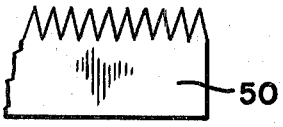
FIGS. 4 and 5 are fragmentary views illustrating a typical cutting knife and grab knife, respectively, in accordance with the invention.

The cutting knife assembly 30 includes a knife blade 50, preferably of sharp serrated design as shown in FIG. 4, supported by a bracket assembly 51 on a torque tube 52 which extends substantially the full distance between the knife arms 31. This subassembly of the knife and torque tube is mounted for swinging movement on the knife arms 31 by means of lever arms 54 having pivotal mountings 55 in brackets 56 secured to the respective knife arms 31. A pair of fluid pressure cylinders 57 connected between the torque tube 52 and the respective knife arms 31 control the swinging movement of the knife blade 50.

The grab knife assembly 40 includes a supporting base 60 mounted on and extending between the outer ends of the arms 41. The base 60 includes means for guiding the web through the cutting station, comprising an anvil bar 61 having a surface 62 for receiving the cutting knife 50 and preferably bolted or otherwise removably secured to the base 60 to provide for vertical adjustment as required to compensate for deflection on a wide machine. A web deflector 63 of sheet metal is secured to the base 60, and extends therefrom upstream of the direction of web travel to support the web immediately downstream from the anvil bar 61, but it terminates short of the anvil bar 61 to provide a space therebetween through which the grab knife 65 can move.

Figure 5:
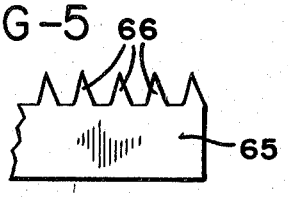

The grab knife 65 is a blade similar to the cutting blade 50 but of lesser penetrating or cutting ability, for example by having teeth 66 (FIG. 5) thereon which have spaces therebetween so that the blade will have a greater ability to penetrate the web W than to cut it. The grab knife 65 is supported for arcuate movement on base 60 by a pivot shaft 70 mounted at opposite ends in bearings 71. The blade 65 is mounted on a supporting bar 72 which is secured to the shaft 70 by a series of collars 73 fixed to the shaft and each including a boss 74 to which the knife bar 72 is secured by bolts 75.

The operating mechanism for grab knife 65 comprises a collar 77 fixed on each end of shaft 70 and provided with two radially extending arms 80 and 81. A spring 82 is connected between each arm 81 and the base 60 to bias the grab knife 65 to its retracted position shown in FIG. 3. Each of the other arms 80 carries a cam roller 85 at its outer end which lies in the path followed, during the cutting movement of the cutting knife 50, by a cam 86 fixed on each end of torque tube 52.

Figure 3:
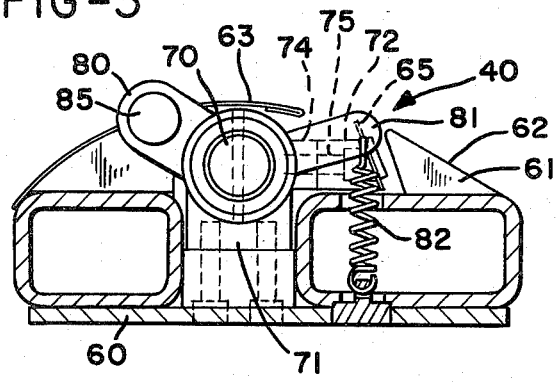
FIG. 3 is a sectional view on the line 3—3 of FIG. 6 illustrating details of the structure and operation of the grab knife in FIG. 1.
Figure 7:
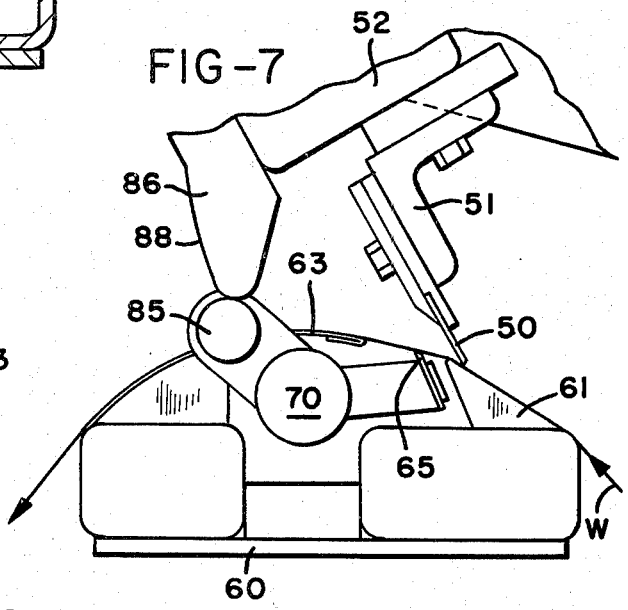
FIGS. 7, 8 and 9 are somewhat diagrammatic sequential views illustrating the operation of the cutting apparatus of FIGS. 1–3.
Figure 6:
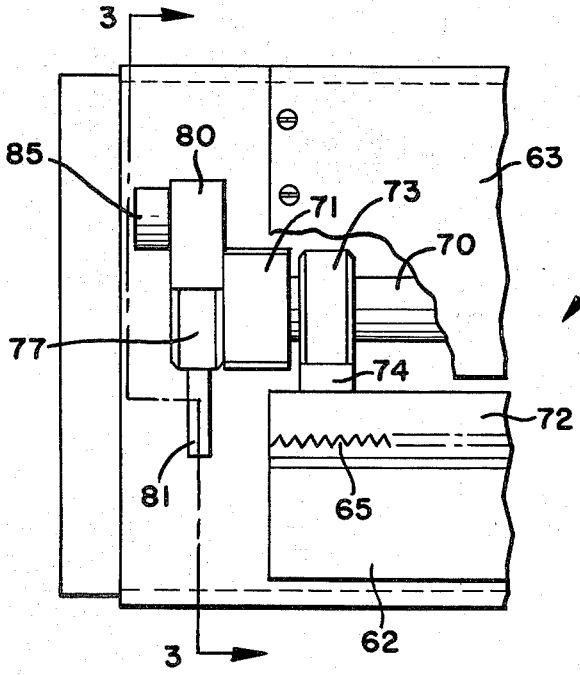
FIG. 6 is a fragmentary plan view of the grab knife subassembly.
Figure 8:
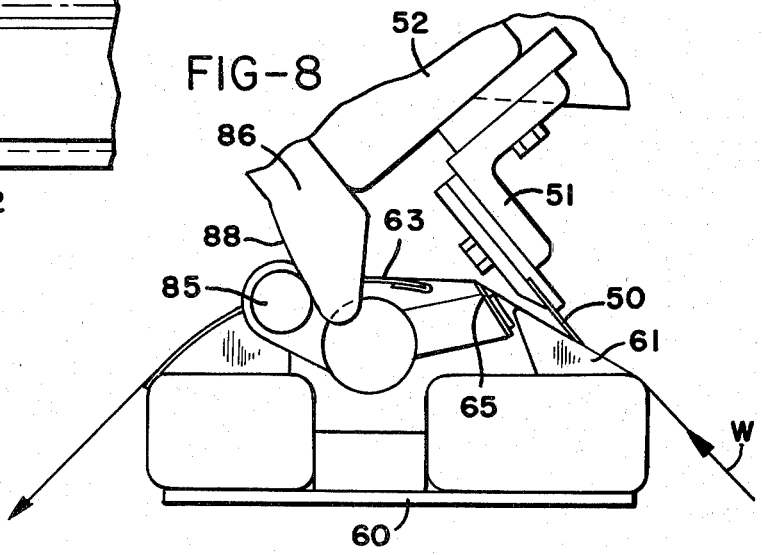
Figure 9:
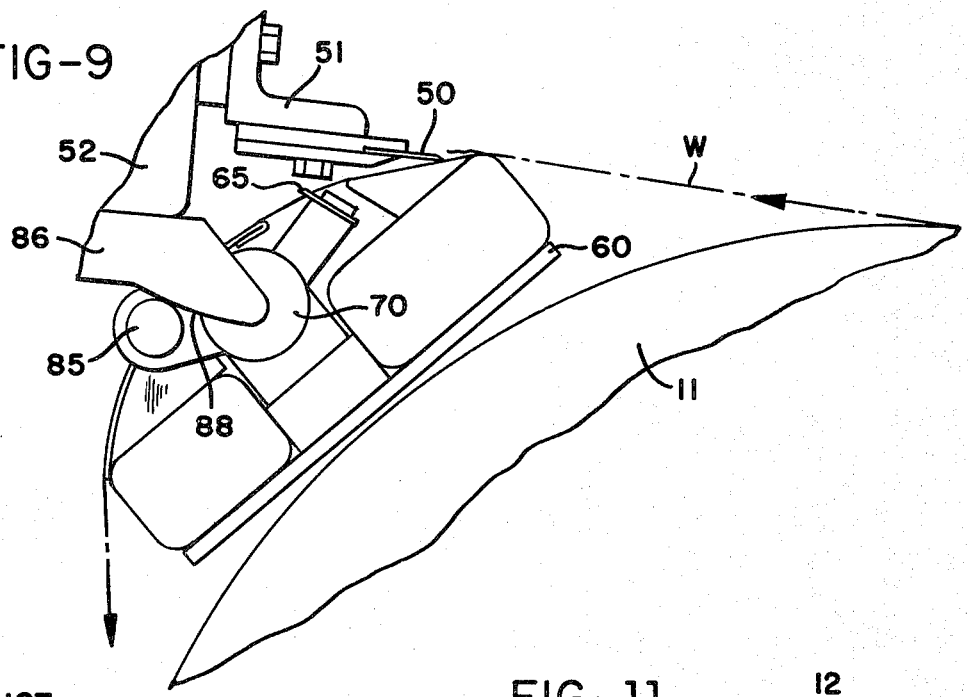

The operating sequence of the two knives is illustrated in FIGS. 7–9 in comparison with FIG. 3. Prior to the cutting of the web and its transfer to a new core, the drive 45 is actuated, by the operator, to move the grab knife assembly 40 in clockwise direction around the drum 11 to its operative position shown in FIG. 1. During this movement, the web will be lifted from the surface of the drum 11 so that the portion of the web between the squaring roll 13 and the nip formed by drum 11 and roll 15 will be supported and guided by the anvil 61 and the deflector 63. Also in preparation for a roll change, the cylinders 33 will be actuated to move the knife arms 31 downwardly to the operating position of the knife assembly 30 shown in full lines in FIG. 1, in which the stop 90 on the end of each arm 31 will seat on top of arm 41. In addition, the operating mechanism of the primary arms 22 will be actuated to move them to the left-hand broken line position shown in FIG. 1 wherein they hold the new core 20 on top of the web and press it into engagement with the drum 11 to bring the core up to web speed.

The cutting sequence is initiated by actuating the cylinders 57 to swing the subassembly which includes the cutting blade 50 in counterclockwise direction as viewed in the drawing. As this subassembly starts downwardly, the cams 86 will engage the cam rollers 85 and force the lever arms 80 downwardly, thereby causing the grab blade 65 to move upwardly (counterclockwise) until the teeth 66 penetrate the web in the fully up position of the knife 65 shown in FIG. 9. The grab knife is held in this position during subsequent cutting movement of the knife 50 by engagement of the cam rollers 84 with the constant dwell position portion 88 of each cam 86.

The concurrent movement of the cutting knife 50 will first bring it into engagement with the web along a portion of the anvil bar surface 62 near the downstream edge thereof as shown in FIG. 7. As the blade 50 continues its stroke, during which it will slide along the anvil bar surface 62, the teeth 66 on the grab blade 65 will complete their penetration of the web and thereby grab or arrest the web along the line defined by the teeth 66. During the remaining stroke of the knife 50, from the position shown in FIG. 7 to the position shown in FIG. 9, the teeth thereon will also penetrate the web and will therefore stretch the isolated short section of web between the two sets of teeth. As a result, the tension in this portion of the web will increase until it is sufficient to cause complete severing of the web by the blade 50.

During this operating sequence, it will be seen that the two knife blades operate in opposite directions, and that a significant component of the movement of each knife, particularly the cutting knife 50, is essentially along the path of the web defined by the anvil bar 61 and deflector 63. The forces which tension the web to the level required for severing are developed in this way, but only in the isolated section of web between the two blades. Cutting tension is therefore developed so quickly that the temporary arresting of the web has no appreciable effect so far as concerns increased tension in the portion of the web between grab blade 65 and the nip of roll 15 with drum 11. Further since the blade 65 is effectively pointing downstream in its fully advanced position, as soon as the web is severed, the pull provided by the continued turning of the roll 15 will draw the web free of the teeth 66 to complete the winding of roll 15. At the same time, the cut leading end of the web will begin to wind on the core 20, which will ordinarily have been prepared with adhesive means in the usual way to assure adhesion to the end of the web thereto.

The effectiveness of the invention in limiting stretching of the web can best be pointed out by the fact that the isolated section of the web where stretching occurs can be as short, in its unstretched state, as one inch or less, as is determined by the relative spacing of the knives 50 and 65 when they first engage the web. More specifically, in a full size embodiment of the invention, the distance between the tips of the teeth of the knives 50 and 65 in FIG. 7 is approximately one inch, while at the limits of the relative movement in opposite directions shown in FIG. 9, this distance is approximately 2.75 inches, thereby making it possible to stretch the isolated section of the web more than 150%. In contrast, the length of the section of web which extends from the downstream edge of the anvil 61 to the nip of roll 15 with drum 11 is between 16 and 18 inches, and with some web materials, it would be physically impossible to stretch that length of web with the aid of normal winding pressure sufficiently to develop enough tension for cutting of the web.

Figure 10:
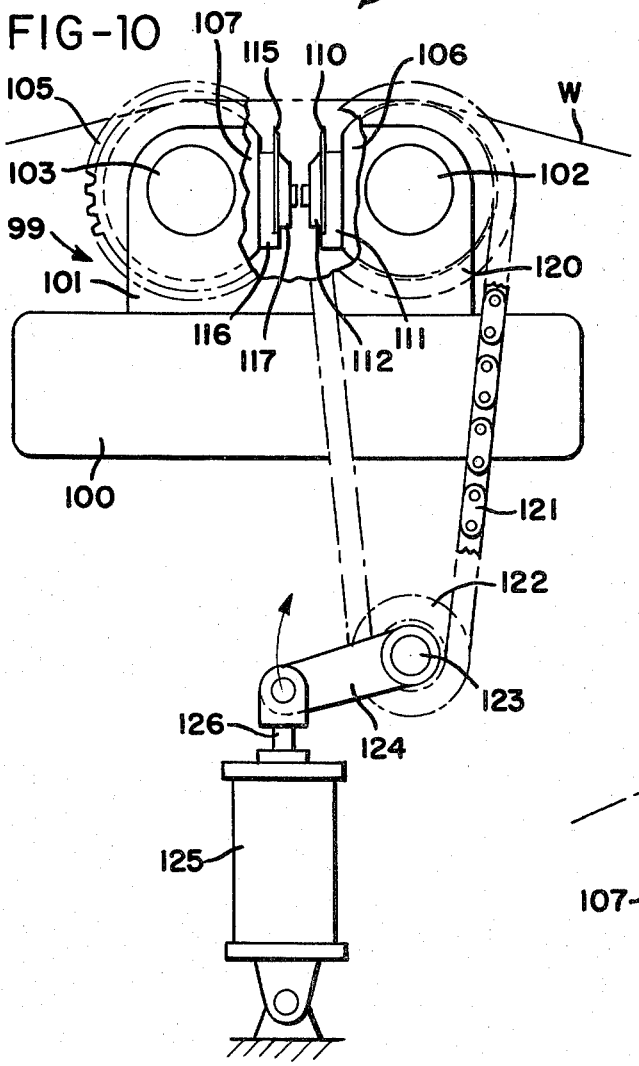
FIG. 10 is a view similar to FIG. 3 showing a modified form of the invention wherein both the grab knife and the cutting knife are carried by a common support.
Figure 11:
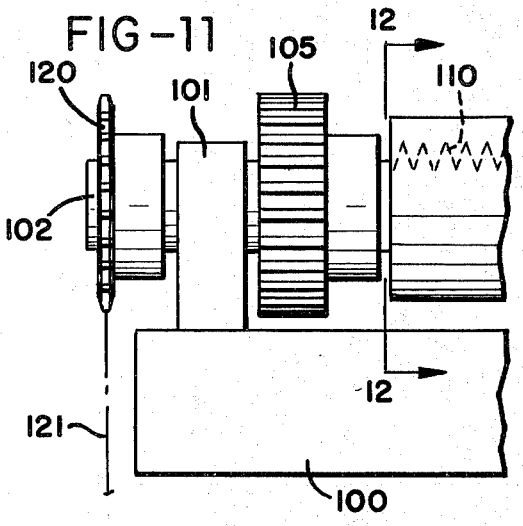
FIG. 11 is a fragmentary plan view of the apparatus of FIG. 10.
Figure 12:
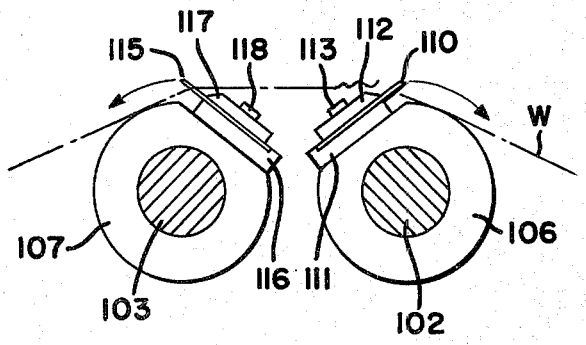
FIG. 12 is a fragmentary section on the line 12—12 of FIG. 11 illustrating the operation of the cutting apparatus shown therein.

FIGS. 10–12 show another form of the invention wherein both the cutting knife and the grab knife are incorporated in the assembly 99 which moves around the driving drum in the same manner as assembly 40. As shown, the assembly 99 includes a base 100 similar to the base 60 and having brackets 101 at opposite ends thereof supporting a pair of rock shafts 102 and 103 which are geared together by a pair of spur gears 105 for rotation in opposite directions.

Each of the rock shafts 102 and 103 carries a roll 106 or 107 which has a flat face along one side to provide for mounting a knife thereon. Cutting knife 110 is mounted on the roll 106 with the aid of retainer bars 111 and 112 and bolts 113. The grab knife 115 is similarly mounted on the flat part of roll 107, by means of bars 116 and 117 and bolts 118. A reversible drive is provided for rocking the shafts 102 and 103 through a limited arc from the rest position of the knives 110 and 115 shown in FIG. 10 to their fully advanced positions shown in FIG. 12. Such drive is shown in FIG. 10 as a sprocket 120 on shaft 102 connected by a chain 121 with a driving sprocket 122 on a shaft 123 having a lever arm 124 thereon which is connected to the piston rod 126 of a double acting piston 125, the shaft 123 and cylinder 125 being readily mounted on one of the arms corresponding to the arms 41 in FIG. 1. Other comparable drives can be used.

In the operation of the form of the invention shown in FIGS. 10–12, when the drive piston 125 is actuated to move the rock shafts from the rest position of the knives shown in FIG. 10, the two shafts rotate in opposite directions to move the knives 110 and 115 into engagement with the web W and then to continue in opposite directions to their limit positions shown in FIG. 12. The operations of the respective knives in this form of the invention are the same as described in connection with FIGS. 7–9, in that as soon as the knives engage the web, they isolate the short section of web lying therebetween and then stretch that section until the tension therein is sufficient for the web to part along the cutting edge knife 110, whereupon the pull on the trailing end of the web will draw it free of the teeth on the grab knife 115 in the same manner as described in connection with the other form of the invention.

While the method herein described, and the forms of apparatus for carrying this method into effect, constitute preferred embodiments of the invention, it is to be understood that the invention is not limited to this precise method and forms of apparatus, and that changes may be made in either without departing from the scope of the invention.

We claim:

1. The method of cutting a web material while limiting the portion thereof subjected to tension during cutting to a predetermined short length, comprising:

a. engaging said web with the blade of a cutting knife at a predetermined first location, b. seizing said web at a location spaced downstream thereof a predetermined short distance from said first location which corresponds to said predetermined short length, and c. stretching the resulting isolated short portion of said web between said locations until said web is severed by said cutting knife.

2. The method defined in claim 1 wherein said seizing step is performed by a knife constructed to penetrate said web without severing the same.

3. The method defined in claim 2 wherein said stretching step is carried out by moving said knives away from each other generally lengthwise of said web.

4. The method defined in claim 1 wherein said seizing step is performed by seizing means, and said stretching step is carried out by relative movement of said knife and seizing means away from each generally lengthwise of said web.

* * * * *